United States Patent [19]

Hager et al.

[11] Patent Number: 4,892,260

[45] Date of Patent: Jan. 9, 1990

[54] KNIFE ROLLER FOR AN APPLIANCE FOR THE PRECOMMINUTION OF FROZEN MATERIAL

[75] Inventors: Juergen Hager, Hueckeswagen; Walter Vieth, Wermelskirchen, both of Fed. Rep. of Germany

[73] Assignee: Magurit Gefrierschneider GmbH, Remscheid-Lennep, Fed. Rep. of Germany

[21] Appl. No.: 301,536

[22] Filed: Jan. 26, 1989

[30] Foreign Application Priority Data

Jan. 27, 1988 [DE] Fed. Rep. of Germany ... 8800928[U]

[51] Int. Cl.[4] ..... B02C 18/18

[52] U.S. Cl. ..... 241/282.2; 241/294; 241/DIG. 17

[58] Field of Search ..... 83/663; 241/293, 294, 241/DIG. 17, 277, 292.1, 282.1, 282.2

[56] References Cited

U.S. PATENT DOCUMENTS 2,299,866 10/1942 Willard ..... 241/DIG. 17 X
2,963,062 12/1960 Hughes ..... 241/293 X
4,515,193 5/1985 Jonsson ..... 241/294 X

FOREIGN PATENT DOCUMENTS 2451313 5/1976 Fed. Rep. of Germany .

*Primary Examiner*—Mark Rosenbaum
*Attorney, Agent, or Firm*—Cushman, Darby & Cushman

[57] ABSTRACT

A knife roller used in an appliance for the precomminution of frozen blocks of material, such as frozen meat, having a roller member on which is fastened at least one cutting member. The cutting member has a U-shaped bow knife formed by a shearing knife and two precutters for cutting strips of material from the frozen blocks. The shearing knife and precutters define a chip passageway in which at least one transverse knife is secured for further cutting the strips of material into smaller chips of material.

23 Claims, 2 Drawing Sheets

KNIFE ROLLER FOR AN APPLIANCE FOR THE PRECOMMINUTION OF FROZEN MATERIAL

BACKGROUND OF THE INVENTION

1. Field of the Invention

The present invention relates to a knife roller used in an appliance for the precomminution of frozen material, such as frozen meat products.

2. Description of Prior Art

Knife rollers are known for their use in flakers or other appliances to precomminute frozen blocks of material, such as frozen meat products, without thawing or defrosting. These appliances prepare the material for further processing into smaller pieces by a mincer or similar appliance. Knife rollers are constructed with a roller member on which one or more cutting members are arranged. The roller member is rotatably mounted, horizontally, at the bottom of a funnel which receives a frozen block of material and directs it into engagement with the cutting members of the roller. As the roller member rotates, each cutting member peels from the frozen block a strip of material which falls into a container beneath the knife roller.

German Offenlegungsschrift No. 2,451,313 discloses such an appliance for the precomminution of frozen material. This device employs a knife roller with cutting members having a shearing knife and two precutters that form a U-shaped main knife or bow knife. As the knife roller rotates, the precutters separate strips of material from a frozen block of meat, which are then severed by the shearing knife. The shearing knife, which is spaced a radial distance from the roller surface, together with the precutters, which extend radially outward from the roller surface, define a passageway through which the frozen strips of material travel during the cutting process.

The cutting members are distributed uniformly around the circumference of a roller member and extend along its entire axial length. Alternatively, the cutting members extend only a short axial length of the roller member. In this arrangement, the cutting paths of adjacent shearing knives partially overlap one another so that the knife roller is able to cut material from the frozen block along the entire axial length of the roller member.

A problem with the knife roller described in German Offenlegungsschrift No. 2,451,313 is that, to provide a high cutting capacity, the cutting members must be equipped with long shearing knives for cutting wide strips of material from the frozen block. However, because the peeled strips of material removed by these cutting members are relatively large, further processing is made more difficult.

SUMMARY OF THE INVENTION

An object of the invention is to provide a knife roller used in an appliance for the precomminution of frozen blocks of material that peels narrow strips or chips from the frozen blocks at a high cutting rate. This is accomplished by providing each cutting member of the knife roller with at least one transverse knife that further cuts the strip of frozen material initially cut away by the bow knife into multiple chips of material that are smaller in size and, thus, can be further processed more easily.

The cutting edge of the transverse knife is mounted flush with the cutting edges of the precutters so that the transverse knife simultaneously severs the strips of material as they are being peeled away from the frozen block by the precutters. The cutting edge of the transverse knife, which is bevelled on both sides, can be aligned parallel to the cutting edges of the precutters, or can be skewed relative thereto. Furthermore, the bow knife and transverse knife of each cutting member can be provided with a cutting edge at their forward and rearward ends so that the knife roller can strip material from a frozen block while rotating in either a clockwise or counter-clockwise direction.

The transverse knife and bow knife of each cutting member are secured directly to the roller member, for instance, by welding. Alternatively, the knife blades can be securely fastened to a support member, preferably by welding, which, in turn, can be removably fastened to the roller member. In this arrangement, a knife roller can be refitted with cutting members having new knives.

To increase the stability of the transverse knife during the cutting process, it is supported in a groove provided in each shearing knife. In addition, a plurality of transverse knives can be secured within the chip passageway to vary the width of the chip produced.

Other objects, features, and advantages of the present invention will become more fully apparent upon consideration of the following detailed description of the preferred embodiments, appended claims, and accompanying drawings.

DETAILED DESCRIPTION OF THE PREFERRED EMBODIMENTS

Figure 1:
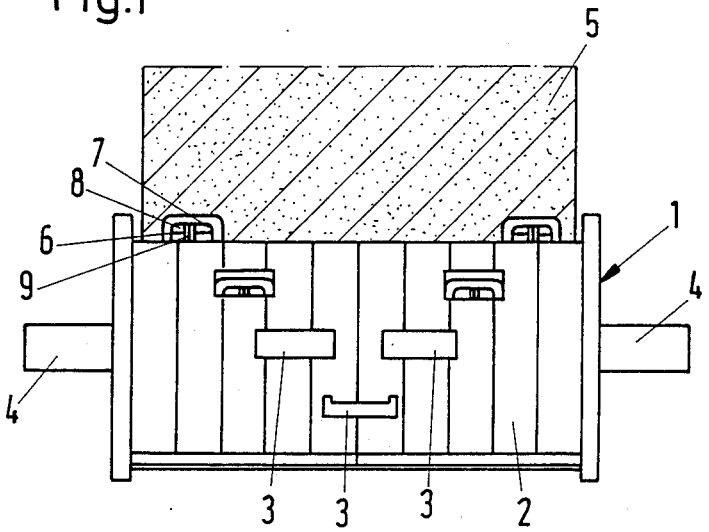
FIG. 1 is a lateral view of the knife roller of the present invention.

As shown in FIG. 1, a knife roller 1 according to the present invention consists of an annular roller member 2 having a plurality of cutting members 3 arranged thereon. Cutting members 3 preferably are distributed uniformly over the circumference of roller member 2 and overlap in the axial direction to cover its entire axial length.

Figure 2:
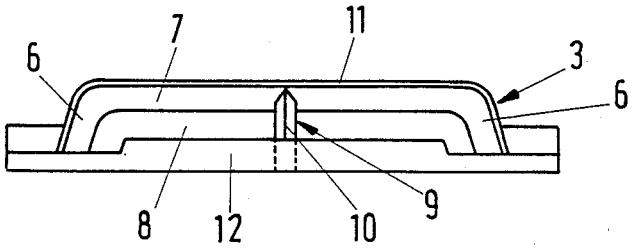
FIG. 2*a* is a lateral view of a first embodiment of the cutting member of the present invention.
FIG. 2*b* is a lateral view of a modified version of the first embodiment of the cutting member of the present invention.

Referring to FIG. 2*a*, cutting members 3 are formed by U-shaped main knives or bow knives 13. The bow knives consist of two precutters 6, a spaced distance apart, that extend radially relative to the surface of roller member 2, and a shearing knife 7, spaced a radial distance from the surface of roller member 2, which connects the radially outermost ends of the precutters 6. The cutting edges of the precutters 6 are aligned essentially parallel to one another.

As illustrated in FIG. 1, roller member 2 is further provided at either end with journal bearings 4 extending along an axis A—A of knife roller 1. The journal bearings 4 rotatably fasten knife roller 1 to the bottom of a funnel (not shown) that receives a frozen block of material 5, such as frozen meat products.

Block 5 is fed through the funnel into contact with roller member 2. As knife roller 1 rotates, precutters 6 engage the frozen block 5 and peel away thin strips of material. Shearing knife 7 severs the strip of material from block 5 which then falls into a container located beneath knife roller 1 as the roller rotates. The radial height of precutters 6 and the axial length of shearing knife 7 determine the thickness and width, respectively, of the strips of frozen material that are peeled from block 5.

FIG. 2*a* illustrates a first embodiment of the cutting member 3 in which precutters 6 and shearing knife 7 are constructed in one piece. The axial cutting edge 11 of shearing knife 7 and the radial cutting edges 11*a* of precutters 6 increase in thickness from a leading forward end. This increasing thickness provides the cutting edges 11, 11*a* of bow knife 13 with greater stability, thus allowing cutting edges 11, 11*a* to penetrate more easily into frozen block 5.

As further shown in FIG. 2*a*, the radial inner ends of the precutters 6 are attached directly to the roller member 2, for example, by welding. The precutters 6 and shearing knife 7 of each cutting member 3 define a chip passageway 8. A transverse knife 9, also preferably welded to roller member 2, is located between the precutters 6 and extends in a radial direction between roller member 2 and shearing knife 7 within passageway 8. In this arrangement, it will be seen that, as roller knife 1 rotates and removes a strip of material from block 5, transverse knife 9 further cuts the strip of material into chips as it travels through chip passageway 8.

In the alternative, as illustrated in FIG. 2*b*, the precutters 6 and transverse knife 9 of cutting member 3 are welded to a support member 12 that is removably secured to roller member 2 using, for example, screws 17. In this arrangement, the cutting members 3 can be easily replaced should the knives become dull. This arrangement also allows existing knife rollers to be refitted with cutting members having transverse knives 9.

To withstand the tensile and compressive stresses that occur during the precomminution process, the bottom edge of transverse knife 9 fits within a groove 15 of support member 12 and is fastened thereto, preferably by welding. To increase the strength and stability of transverse knife 9, its top edge can be supported in a groove 16 formed in shearing knife 7.

Figure 4:
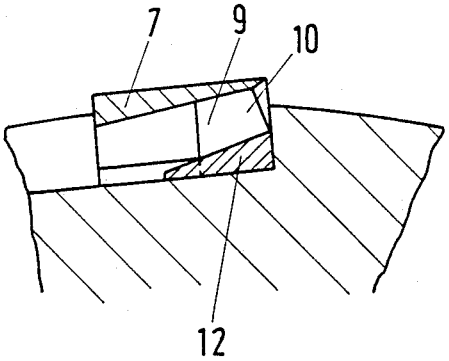
FIG. 4*a* is a cross-section of the knife roller of FIG. 2*a* taken along line 4—4.
FIG. 4*b* is a cross-section of the knife roller of FIG. 2*b* taken along line 4—4 in modified form.

As shown in FIGS. 4*a* and 4*b*, support member 12 can be fastened, together with cutting member 3, directly on the radially outermost surface 18 of roller member 2 (FIG. 4*a*) or in a recess 14 formed in roller member 2 (FIG. 4*b*).

Figure 3:
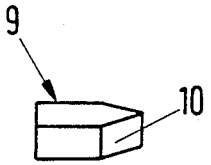
FIG. 3*a* is a lateral view of a transverse knife of the present invention.
FIG. 3*b* is a lateral view of a modified version of the transverse knife of the present invention.

Referring to FIG. 3*a*, transverse knife 9 has a narrow cutting edge 10 that is bevelled on both sides and, preferably, is aligned approximately parallel to the cutting edges of precutters 6. Transverse knife 9 has a cutting edge at its forward end so that it can strip material from block 5 when roller member 2 rotates in a clockwise direction as illustrated in FIG. 4*b*.

As shown in FIG. 3*b*, transverse knife 9 is provided with cutting edges 10 at both its forward and rearward ends and has an enlarged length that extends over the entire region of chip passageway 8. In a further modification, precutters 6 and shearing knife 7 can be provided with cutting edges at their forward and rearward ends so that knife roller 1 can strip material from block 5 while rotating in either a clockwise or counter-clockwise direction as illustrated in FIG. 4*a*.

Preferably, transverse knife 9 has only one cutting edge at the forward end for rotation in a clockwise direction and has a short longitudinal length that extends only over the forward region of chip passageway 8. Also, the cutting edge 10 of transverse knife 9 is arranged essentially perpendicular to the axial cutting edge of shearing knife 7.

As illustrated in the embodiments of FIGS. 2*a* and 2*b*, transverse knife 9 is arranged approximately an equal distance between the two precutters 6 so that the strip of material removed by bow knife 13 is divided into two smaller chips of equal size. The preferred width of the strips of material peeled by bow knife 13 is approximately 10 cm. Where transverse knife 9 is centrally located between the two precutters 6, the width of the two equally-sized chips will be approximately 5 cm. If desired, transverse knife 9 can be shifted axially toward one of the precutters 6 to cut unequal widths of frozen material.

Figure 5:
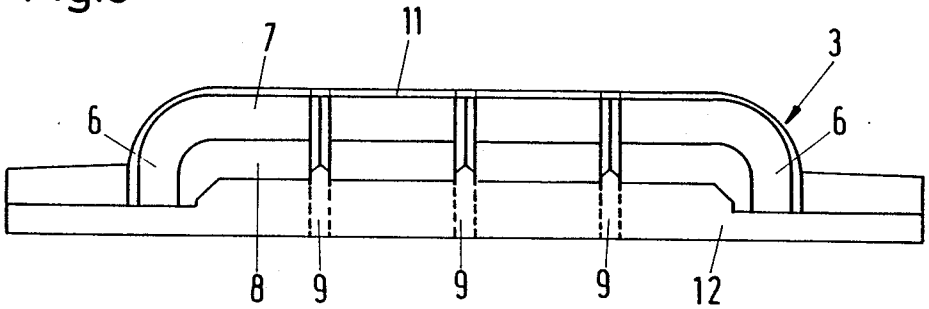
FIG. 5 is a second embodiment of the cutting member of the present invention.

FIG. 5 shows a second embodiment of the present invention in which the cutting members 3 of knife roller 1 are provided with three transverse knives 9. These transverse knives 9, arranged and fastened between precutters 6, divide the forward region of chip passageway 8 into four equal portions, causing the strips of material peeled away from block 5 to be cut into four smaller chips of equal size.

Figure 7:
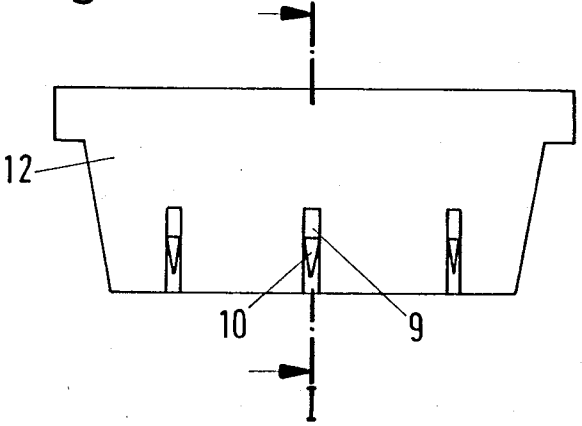
FIG. 7 is a top view of the support structure for the transverse knives of the cutting member of FIG. 5.

FIG. 7 illustrates the support member 12 for the cutting member 3 according to FIG. 5. The transverse knives 9 are fastened to support member 12, for example, by welding, and extend perpendicularly to the axial cutting edge of shearing knife 7.

Figure 6:
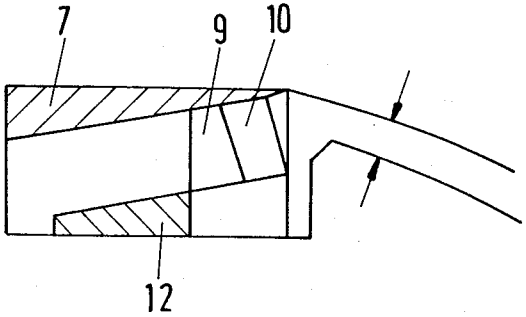
FIG. 6 is a cross-section of the cutting member of FIG. 5, taken along line 6—6, mounted on the roller member of the present invention.

FIG. 6 is a cross-section of roller knife 1 similar to that of FIG. 4*b* showing cutting member 3 arranged in recess 14 of roller member 2. The radial height of the bow knife 13 above the surface 18 of roller member 2, as indicated by arrows, determines the radial thickness of a strip of material that can be peeled off by bow knife 13. The peeled strip has a smaller radial thickness than that of chip passageway 8 and, thus, is able to travel easily through the passageway 8 as roller member 2 rotates in a clockwise direction.

Although the invention has been described in connection with what is presently considered to be the most practical and preferred embodiments, it is to be understood that the invention is not limited to the disclosed embodiments, but rather, is intended to cover various modifications and equivalent arrangements included within the spirit and scope of the appended claims.

What is claimed is:

1. A knife roller used in an appliance for the precomminution of a frozen block of material, comprising:

an annular roller member having an outer surface which is rotatable about an axis;

at least one cutting member fastened to said roller member;

said cutting member having a U-shaped bow knife for cutting strips of material from said frozen block, said bow knife formed by a shearing knife spaced a radial distance from the surface of said roller member and two radially extending precutters, each of said precutters attached at their radially outermost end to respective ends of said shearing knife, and at their radially innermost end to said roller member, said shearing knife and said precutters defining a chip passageway;

said cutting member further having at least one substantially radially extending transverse knife secured between said precutters within said chip passageway for cutting said strips of material removed by said bow knife into smaller chips of material.

2. The knife roller as set forth in claim 1, wherein said roller member is provided with a plurality of cutting members distributed uniformly over the circumference of said roller member.

3. The knife roller as set forth in claim 2, wherein said cutting members extend over a short axial distance of said roller member and axially overlap to cover the entire axial length of said roller member.

4. The knife roller as set forth in claim 1, further comprising journal bearings at either end of said annular roller member, said journal bearings extending along the axis of said roller member for mounting said roller member in said appliance.

5. The knife roller as set forth in claim 1, wherein said transverse knife has a short longitudinal length that extends only over a forward region of said chip passageway.

6. The knife roller as set forth in claim 1, wherein said transverse knife is provided with a cutting edge bevelled on both sides.

7. The knife roller as set forth in claim 1, wherein said shearing knife, precutters, and transverse knife are each provided with cutting edges at their leading, forward ends.

8. The knife roller as set forth in claim 7, wherein said cutting edges of said shearing knife and said precutters increase in thickness from a leading forward end to give said cutting edges greater stability during the precomminution process.

9. The knife roller as set forth in claim 7, wherein said shearing knife, precutters, and transverse knife are provided with cutting edges at their rearward ends so that knife roller can be used while rotating in either a clockwise or counter-clockwise direction.

10. The knife roller as set forth in claim 7, wherein said cutting edge of said transverse knife is essentially perpendicular to said cutting edge of said shearing knife.

11. The knife roller as set forth in claim 7, wherein said transverse knife is centrally located between said precutters to produce chips of equal size.

12. The knife roller as set forth in claim 1, wherein said transverse knife is located axially closer to one of said precutters to produce chips of unequal size.

13. The knife roller as set forth in claim 1, wherein said cutting member is secured directly to said annular roller member.

14. The knife roller as set forth in claim 13, wherein said cutting member is secured to said annular roller member by welding.

15. The knife roller as set forth in claim 13, wherein said cutting member is mounted in a recess formed in said annular roller member.

16. The knife roller as set forth in claim 1, wherein said cutting member further comprises a support member, said transverse knife is secured to said support member, and said support member is removably secured to said roller member.

17. The knife roller as set forth in claim 16, wherein said transverse knife is secured to said support member by welding.

18. The knife roller as set forth in claim 16, wherein said support member is removably secured to said roller member by screws.

19. The knife roller according to claim 16, wherein said support member is provided with a groove therein for supporting a bottom edge of said transverse knife.

20. The knife roller as set forth in claim 16, wherein said cutting member is mounted in a recess formed in said annular roller member.

21. The knife roller according to claim 1, wherein said shearing knife is provided with a groove therein for supporting a top edge of said transverse knife.

22. The knife roller as set forth in claim 1, wherein said cutting member is provided with a plurality of said transverse knives between said precutters for cutting said strips of material removed by said bow knife into a plurality of smaller-sized chips.

23. The knife roller as set forth in claim 22, wherein said plurality of transverse knives have cutting edges that are aligned parallel to one another.

* * * * *